United States Patent [19]

Ahroni

[11] 4,309,069

[45] * Jan. 5, 1982

[54] FUSED PLUG ASSEMBLY WITH FUSE UNIT HAVING SPARE FUSE ELEMENTS

[76] Inventor: Joseph M. Ahroni, P.O. Box 3907, Seattle, Wash. 98124

[ * ] Notice: The portion of the term of this patent subsequent to Jan. 5, 1999, has been disclaimed.

[21] Appl. No.: 108,131

[22] Filed: Dec. 28, 1979

Related U.S. Application Data

[63] Continuation-in-part of Ser. No. 13,319, Feb. 21, 1979, Pat. No. 4,274,698.

[51] Int. Cl.[3] ..... H01R 13/68

[52] U.S. Cl. ..... 339/147 P; 337/198; 337/293; 337/297

[58] Field of Search ..... 339/147, 195, 196, 206 P, 339/157 C; 337/197, 198, 297, 194, 211, 212, 220, 257, 293, 295

[56] References Cited

U.S. PATENT DOCUMENTS

| | | | |
|---|---|---|---|
| 2,462,934 | 3/1949 | Athey | 339/147 P |
| 2,640,184 | 5/1953 | Bauer | 339/195 R |
| 3,585,556 | 6/1971 | Hingorany et al. | 337/297 |
| 3,715,698 | 2/1973 | Blewitt | 337/297 |
| 4,080,039 | 3/1978 | Ahroni | 339/147 R |
| 4,208,645 | 6/1980 | Harmon et al. | 337/297 |

*Primary Examiner*—John McQuade

*Attorney, Agent, or Firm*—Seed, Berry, Vernon & Baynham

[57] ABSTRACT

A fused electrical plug assembly is provided having a plug body with a fuse socket between projecting prongs, and a push-in fuse unit is received in the fuse socket. The fuse unit has a pair of active fuse elements on one side and a spare pair on another side which can be used by removing the fuse unit, turning it to properly orient the spare pair, and pushing it back into the fuse socket.

6 Claims, 5 Drawing Figures

FUSED PLUG ASSEMBLY WITH FUSE UNIT HAVING SPARE FUSE ELEMENTS

This application is a continuation-in-part of my copending application Ser. No. 013,319, filed Feb. 21, 1979, now U.S. Pat. No. 4,274,698.

BACKGROUND OF THE INVENTION

1. Field of the Invention

The present invention relates to fused electrical plugs and particularly to those for use with Christmas tree light sets and other decorative light sets.

2. Description of the Prior Art

Electrical plugs having internal fuses for opening an electrical circuit responsive to excess current flow are in use on decorative light sets. Typical designs are shown in U.S. Pat. Nos. 3,976,967; 4,080,039 and 4,178,061.

Need has arisen for a safe, reliable, cheaper and simpler plug unit having a minimum of parts and in which a fuse is easy to change. There is also a need for a plug unit providing its own spare fuse. The present invention aims to meet these needs.

SUMMARY OF THE INVENTION

In accordance with the present invention the use of fuse carriers and fuse access covers has been eliminated by providing a push-in fuse unit having an enlarged head located between the prongs which can be engaged for removal of the units. The fuse unit is rectangular in cross-section and has an active pair and a spare pair of fuse elements along two of its sides, the active pair engaging two sets of contacts provided by the prong members and the wire leads at the same side of a socket receiving the fuse unit. The spares can be put into use by removing the fuse unit from the socket and reinserting it after turning it 180 degrees.

DETAILED DESCRIPTION OF THE INVENTION

Figure 1:
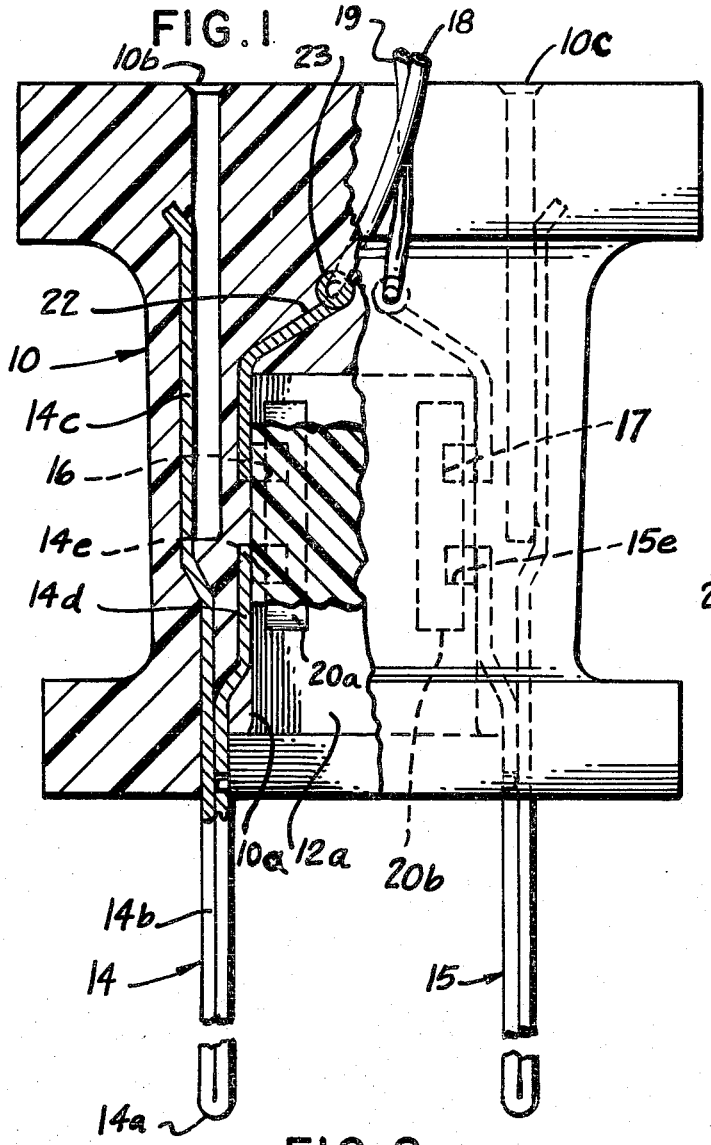
FIG. 1 is a side elevational view, partly in vertical section of a fused plug assembly embodying the present invention.
Figure 3:
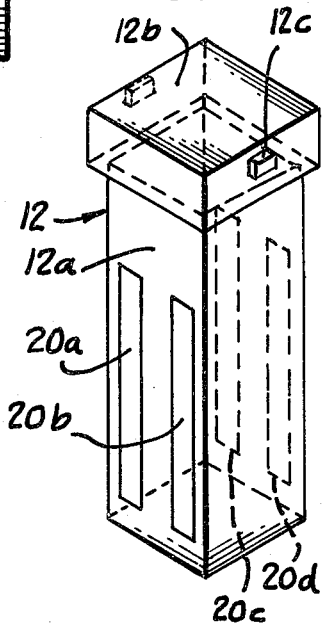
FIG. 3 is a perspective elevational view of the fuse unit.
Figure 4:
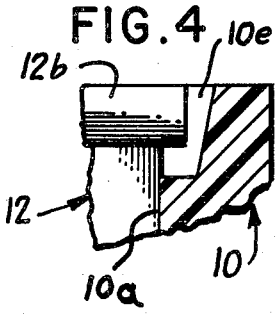
FIG. 4 is a detail sectional view taken along the line 4—4 of FIG. 2.
Figure 2:
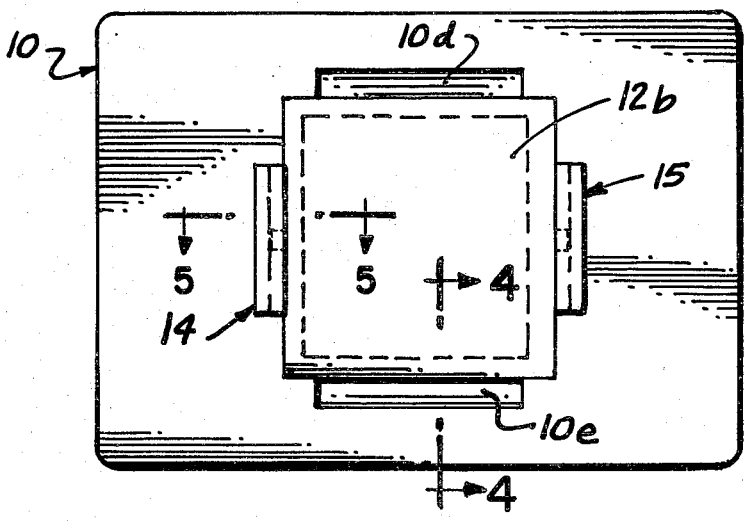
FIG. 2 is a bottom plan view of the plug assembly.
Figure 5:
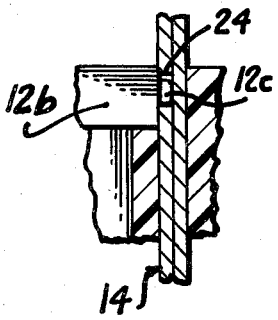
FIG. 5 is a detail sectional view taken along the line 5—5 of FIG. 2.

Referring to the drawings it is seen that the fused plug assembly of the present invention comprises a plug body 10, a push-in fuse unit 12, a pair of prong members 14-15, and a pair of wire contacts 16-17 connected to a pair of leads 18-19. The plug body 10 is formed with a central rectangular fuse receiving socket 10*a* at the front and a pair of standard prong sockets 10*b*, 10*c* at the rear.

The fuse unit 12 has a body 12*a* shaped to fit snugly in the socket 10*a* and formed with an enlarged head 12*b*. Two pairs of parallel spaced fuse element strips 20*a*-20*b* and 20*c*-20*d* extend along opposite outer faces of the fuse body 12*a*, one pair 20*a*-20*b* of these strips electrically interconnecting the prong members 14-15 with the wire contacts 16-17 while the other pair 20*c*-20*d* remains as a spare. If the fuse body 12*a* is made square, the other two longitudinal sides can be provided with two more pairs of spare fuse element strips.

The prong members 14,15 are alike, but positioned with opposite orientation; hence, only prong member 14 will be described in detail. It is formed by doubling back the brass prong stock from the projecting tip 14*a* to form an exposed prong 14*b* of double thickness for insertion into a wall socket or other plug. Within the plug body the prong member has two separated legs, one leg 14*c* being outwardly offset to extend along the outer side of the prong socket 10*b* to engage the respective prong of an add-on plug when plugged into the plug body 10. The other leg is bent inwardly and then rearwardly to provide leg portion 14*d* from which a contact portion 14*e* projects toward the center of the plug body at right angles to 14*e*. This contact portion 14*e* is opposed by a contact portion 15*e* on the opposite side of the fuse socket. The contacts 16-17 are in coplanar alignment with and spaced rearwardly from the contact portions 14*e*, 15*e* so that the fuse elements 20*a*, 20*c* will engage and electrically interconnect them.

As indicated in FIG. 1, contact 16, for example, is formed as a tab bent at right angles from a contact member 22 extending rearwardly in general alignment with prong portion 14*d*. This contact member may then be bent inwardly somewhat before making a crimped connection at 23 with the wire of insulated lead 18. Contact 17 is connected to lead 19 in the same manner.

It will be noted that the prong portion of the plug body 10 between the prongs 14-15 is recessed and stepped inwardly to the mouth of the fuse socket 10*a* to match the enlarged head 12*b* of the fuse unit. The head 12*b* of the fuse body is given a width to fit snugly between the prongs 14-15. This snug fit together with a relatively snug fit of the fuse body 12 in the fuse cavity 10*a* keeps the fuse unit 12 in pushed-in position relative to the plug body 10.

The prong members 14-15 can be provided with a rectangular cutout 24 opposite the fuse plug head 12*b* to receive a locking tab 12*c* projecting from the side of the latter. The fuse body is molded from a sufficiently resilient plastic as to permit the locking tab 12*c* to ride along the prong 14 or 15 to the cutout 24 while the fuse unit is being pushed into the fuse socket 10*a*. In this regard, the fuse body 12*a* may be hollow through a major part of its length so that it can yield inwardly to allow for a snug fit of the fuse body in the fuse cavity so that there will be good contact between the fuse elements 20*a*, 20*c* and the wire contacts 16-17 and prong contact portions 14*e*, 15*e*.

The fuse elements 20*a*–*d* are formed from a suitable conductive foil such as zinc foil about 0.0001 inches thick and are secured by a suitable adhesive to the fuse body. The exact thicknes and width of the fuse elements of course depend upon the desired fuse rating.

It will be appreciated that the plug body 10 can be injection molded in one piece with the prong members 14, 15, contacts 16-17, contact members 22, and connected wires 18-19 in place in the mold. The body of the fuse 12 can also be injection molded as one piece whereupon the fuse elements 20*a*–*d* are attached as by a suitable pressure sensitive adhesive. Hence the plug assembly need only have two plastic parts.

If one of the fuse elements 20*a*, 20*b* should sever because of an overload or short circuit, after the difficulty is corrected the spare elements 20*c*, 20*d* can be placed in operation merely by removal of the fuse unit, turning it 180 degrees, and pushing it back into the fuse socket as before. If all four sides of the fuse body 12*a* are provided with fuse elements, the fuse unit would of course be turned 90 degrees to properly orient a spare pair of fuse elements for use. To assist in removal of the fuse unit when desired, the front face of the plug body 10 may be formed with a pair of leveled recesses 10*d*, 10*e* shaped to expose the underside of the overlying portions of the enlarged head 12*b* of the fuse body.

I claim:

1. A fused plug assembly, comprising:

a plug body formed with a pair of parallel spaced elongated prong sockets open to one end of the plug body and a central elongated fuse socket having a mouth open to the opposite end of the plug body;

a pair of parallel spaced prong members projecting as prongs from said opposite end of the plug body in alignment with said prong sockets, said prong members each having two legs within the plug body, one leg being exposed to a respective of said prong sockets and the second leg being exposed by a contact portion to the fuse socket;

a pair of wire leads extending from the plug body between the ends of the latter and having a pair of spaced wire contacts connected thereto, said wire contacts being exposed to said fuse socket in general alignment with and spaced from respective of said contact portions and said wire contacts and contact portions being coplanar;

a push-in fuse unit having a fuse body slidably received in the fuse socket with its head located between said prongs, said unit having an active pair of parallel spaced elongated fuse elements on one side of said fuse body each arranged to engage a said contact portion and respective wire contact, and said unit having a matching spare pair of fuse elments arranged to function in place of the active pair when said fuse body is removed and repositioned in said socket.

2. A fused plug assembly according to claim 1 in which said fuse body is generally rectangular in cross-section and has said pair of space fuse elements on the side thereof opposite from the side having the said active pair of fuse elements.

3. A fused plug assembly according to claim 1 in which said fuse body is generally square in cross-section and has said pair of spare fuse elements on one of the other sides thereof.

4. A fused plug comprising:

a plug body;

a pair of parallel spaced prongs projecting from one end of the plug body;

said plug body having a socket having an access mouth at one end of the plug body and said prongs having planar contact portions exposed at one side of said socket;

a pair of contacts exposed to said side of the socket and arranged in aligned spaced relation to respective of said contact portions;

a removable fuse body fitting into said socket and presenting a pair of spaced fuse elements electrically interconnecting said contacts and said contact portions, said fuse body also having a spare pair of fuse elements arranged to interconnect said contacts and said contact portions when said fuse body is removed and repositioned in said socket.

5. A fused plug according to claim 4 in which said fuse elements comprise conductive foil strips secured to said fuse body.

6. A fuse unit comprising:

a non-conductive fuse body with two opposite parallel sides; and a respective matching pair of parallel spaced conductive fuse elements along each of said two sides, whereby one pair may be spares while the other pair is active, and may be placed in active position by turning the fuse body over.

* * * * *